US009489910B2

(12) United States Patent
Koo et al.

(10) Patent No.: US 9,489,910 B2
(45) Date of Patent: Nov. 8, 2016

(54) DISPLAY DEVICE

(71) Applicant: SAMSUNG DISPLAY CO., LTD., Yongin, Gyeonggi-Do (KR)

(72) Inventors: Bonyong Koo, Chungcheongnam-do (KR); Dongyeon Son, Asan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 23 days.

(21) Appl. No.: 14/525,368

(22) Filed: Oct. 28, 2014

(65) Prior Publication Data

US 2015/0287379 A1 Oct. 8, 2015

(30) Foreign Application Priority Data

Apr. 4, 2014 (KR) ..... 10-2014-0040381

(51) Int. Cl.
*G09G 3/20* (2006.01)
*G09G 3/36* (2006.01)

(52) U.S. Cl.
CPC ..... *G09G 3/3648* (2013.01); *G09G 3/3614* (2013.01); *G09G 2310/062* (2013.01); *G09G 2320/0271* (2013.01)

(58) Field of Classification Search
CPC ..... G09G 2330/021; G09G 2330/02; G09G 3/369
USPC ..... 345/58, 87–100, 211–213
See application file for complete search history.

(56) References Cited

U.S. PATENT DOCUMENTS 7,319,448 B2 1/2008 Kim et al.
8,368,630 B2 2/2013 Lee et al.
8,416,164 B2 4/2013 Hwang et al.
2008/0266219 A1 10/2008 Kim et al.
2010/0245326 A1 9/2010 Xiao
2011/0279431 A1 11/2011 Lee et al.
2014/0022227 A1* 1/2014 Kim ..... G06F 3/038 345/212
2014/0313113 A1* 10/2014 Jang ..... G09G 3/3614 345/87
2015/0029170 A1* 1/2015 Shin ..... G09G 3/3648 345/212

FOREIGN PATENT DOCUMENTS

JP 2006-072211 3/2006
JP 2010-015050 1/2010
KR 1019950000984 1/1995
KR 1019950006519 3/1995
KR 1020040062149 7/2004
KR 1020110111832 10/2011
KR 1020110114363 10/2011

* cited by examiner

*Primary Examiner* — Kimnhung Nguyen
(74) *Attorney, Agent, or Firm* — F. Chau & Associates, LLC

(57) ABSTRACT

A display device includes a display panel including gate lines, data lines, and pixels connected to the gate lines and the data lines, a data driver configured to apply data voltages to the pixels through the data lines, and a common voltage generator configured to apply first and second common voltages to the pixels. The pixels connected to odd-numbered gate lines of the gate lines are connected to the data lines disposed at a first side thereof, the pixels connected to even-numbered gate lines of the gate lines are connected to the data lines disposed at a second side thereof, and the common voltage generator is configured to apply the first common voltage to the pixels connected to the odd-numbered gate lines and apply the second common voltage to the pixels connected to the even-numbered gate lines.

20 Claims, 7 Drawing Sheets

FIG. 3

| PX11 | PX12 | PX13 | PX14 |
|---|---|---|---|
| + | − | + | − |
| PX21 | PX22 | PX23 | PX24 |
| − | + | − | + |
| PX31 | PX32 | PX33 | PX34 |
| + | − | + | − |
| PX41 | PX42 | PX43 | PX44 |
| − | + | − | + |

[1-Frame]

| PX11 | PX12 | PX13 | PX14 |
|---|---|---|---|
| − | + | − | + |
| PX21 | PX22 | PX23 | PX24 |
| + | − | + | − |
| PX31 | PX32 | PX33 | PX34 |
| − | + | − | + |
| PX41 | PX42 | PX43 | PX44 |
| + | − | + | − |

[2-Frame]

[Odd Gate Line Pixel]

[Even Gate Line Pixel]

DISPLAY DEVICE

CROSS-REFERENCE TO RELATED APPLICATIONS

This application claims priority under 35 U.S.C. §119 to Korean Patent Application No. 10-2014-0040381 filed on Apr. 4, 2014, the disclosure of which is hereby incorporated by reference in its entirety.

TECHNICAL FIELD

Exemplary embodiments of the present disclosure relate to a display device.

DISCUSSION OF THE RELATED ART

A display device typically includes a display panel that displays an image, and gate and data drivers that drive the display panel. The display panel typically further includes gate lines, data lines, and pixels connected to the gate lines and the data lines. The gate lines receive gate signals from the gate driver and the data lines receive data voltages from the data driver. The pixels receive the data voltages through the data lines in response to the gate signals provided through the gate lines. The pixels display gray scales corresponding to the data voltages, and thus, desired images are displayed.

When constant voltages are continuously applied to a pixel electrode and a common electrode, liquid crystal molecules may be deteriorated and crosstalk may occur on the display panel. To prevent the occurrence of crosstalk, a phase of the data voltage applied to the display panel may be inverted. Various driving methods of the display panel such as, for example, a line inversion driving method, a column inversion driving method, a dot inversion driving method, and a Z-inversion driving method may be used to drive the display panel. The line inversion driving method inverts the phase of the data voltage applied to the data lines every line. The column inversion driving method inverts the phase of the data voltage applied to the data lines every column. The dot inversion driving method inverts the phase of the data voltage applied to the data lines every column and every line.

SUMMARY

Exemplary embodiments of the present disclosure provide a display device configured to be driven using a Z-inversion driving method in order to apply common voltages to a display panel thereof.

According to an exemplary embodiment of the present disclosure, a display device includes a display panel including gate lines, data lines, and pixels connected to the gate lines and the data lines, a data driver configured to apply data voltages to the pixels through the data lines, and a common voltage generator configured to apply first and second common voltages to the pixels. The pixels connected to odd-numbered gate lines of the gate lines are connected to the data lines disposed at a first side (e.g., a left side) thereof to receive the data voltages, the pixels connected to even-numbered gate lines of the gate lines are connected to the data lines disposed at a second side (e.g., a right side) thereof to receive the data voltages, and the common voltage generator is configured to apply the first common voltage to the pixels connected to the odd-numbered gate lines and apply the second common voltage to the pixels connected to the even-numbered gate lines.

According to an exemplary embodiment of the present disclosure, a method of driving a display device includes applying a plurality of data voltages to a plurality of pixels of the display device through a plurality of data lines, applying a first common voltage to pixels of the plurality of pixels connected to odd-numbered gate lines of a plurality of gate lines, and applying a second common voltage to pixels of the plurality of pixels connected to even-numbered gate lines of the plurality of gate lines. The pixels of the plurality of pixels connected to the odd-numbered gate lines of the plurality of gate lines are connected to data lines of the plurality of data lines disposed at a first side thereof, and the pixels of the plurality of pixels connected to the even-numbered gate lines of the plurality of gate lines are connected to data lines of the plurality of data lines disposed at a second side thereof.

According to exemplary embodiments of the present disclosure, viewing characteristics of the display device may be improved.

BRIEF DESCRIPTION OF THE DRAWINGS

The above and other features of the present disclosure will become more apparent by describing in detail exemplary embodiments thereof with reference to the accompanying drawings, in which:

FIG. 3 is a table showing polarities of the pixels shown in FIG. 2 in a first frame according to an exemplary embodiment of the present disclosure.

DETAILED DESCRIPTION OF THE EXEMPLARY EMBODIMENTS

Figure 1:
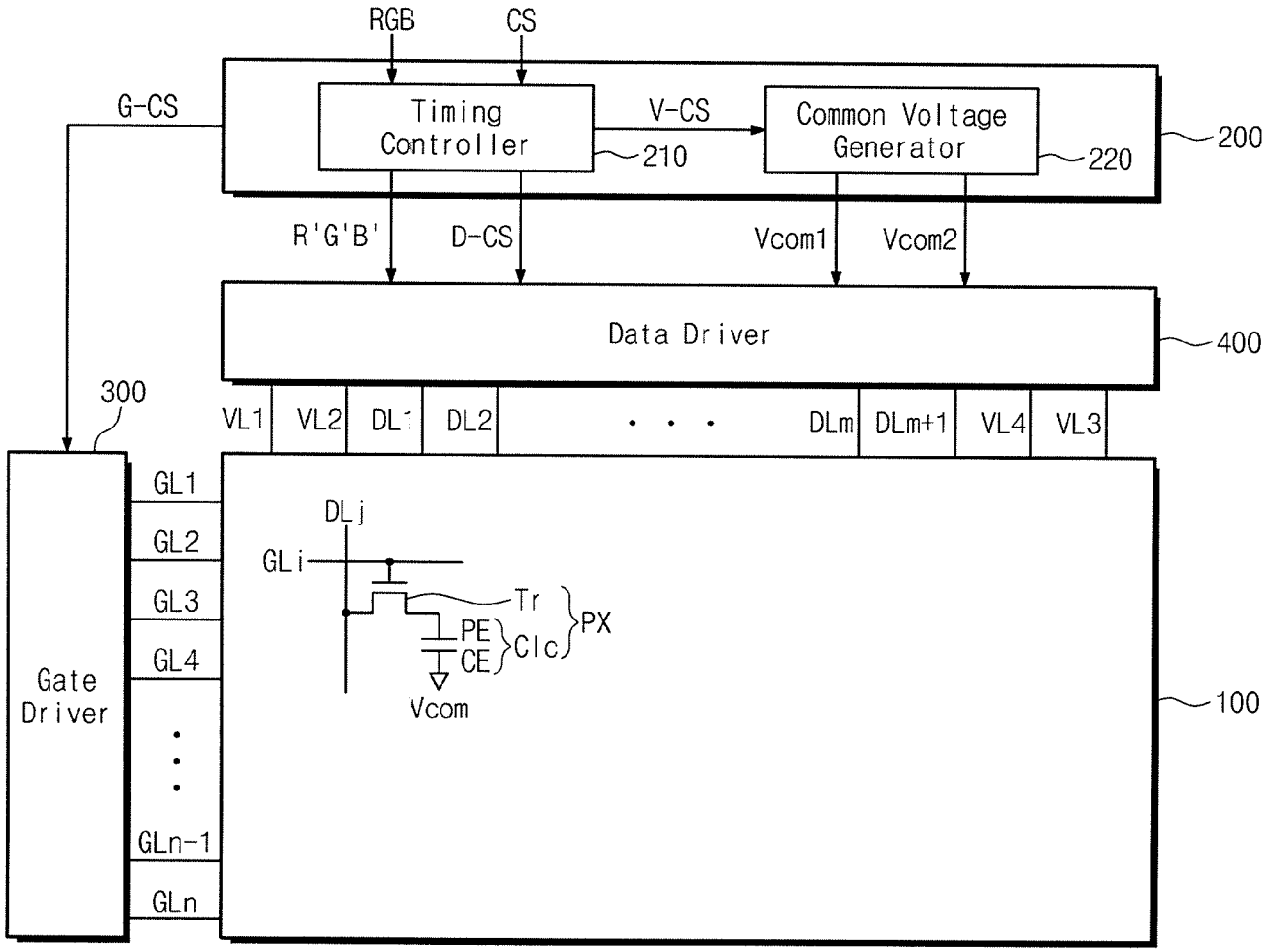
FIG. 1 is a block diagram showing a display device according to an exemplary embodiment of the present disclosure.

Exemplary embodiments of the present disclosure will be described more fully hereinafter with reference to the accompanying drawings. Like reference numerals may refer to like elements throughout the accompanying drawings.

It will be understood that when an element or layer is referred to as being "on", "connected to" or "coupled to" another element or layer, it can be directly on, connected or coupled to the other element or layer or intervening elements or layers may be present.

It will be further understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

FIG. 1 is a block diagram showing a display device according to an exemplary embodiment of the present disclosure.

Referring to FIG. 1, a display device includes a display panel 100, a printed circuit board 200, a gate driver 300, and a data driver 400.

The display panel 100 includes a plurality of pixels PX. For convenience of explanation, FIG. 1 shows one pixel PX of the plurality of pixels PX, one gate line GLi of the plurality of gate lines GL1 to GLn connected to the pixels PX, and one data line DLj of data lines DL1 to DLm+1 connected to the pixels PX. Each of n and m is an integer greater than zero, i is an integer greater than zero and less than or equal to n, and j is an integer greater than zero and less than or equal to m+1. The gate lines GL1 to GLn and the data lines DL1 to DLm+1 are disposed on the display panel 100 and connected to the pixels PX. The pixels PX are arranged in a matrix form. Herein, for convenience of explanation, the configuration of one pixel PX of the plurality of pixels PX is described.

The gate lines GL1 to GLn extend in a row direction and cross the data lines DL1 to DLm+1, which extend in a column direction. The pixel PX is connected to the corresponding gate line GLi and the corresponding data line DLj.

The pixel PX connected to the gate line GLi and the data line DLj includes a thin film transistor Tr and a liquid crystal capacitor Clc connected to the thin film transistor Tr. The thin film transistor Tr includes a gate electrode connected to the gate line GLi, a source electrode connected to the data line DLj, and a drain electrode connected to the liquid crystal capacitor Clc. As described above, the other pixels PX of the plurality of pixels PX have the same structure and function as those of the pixel PX described herein.

The liquid crystal capacitor Clc is defined by a pixel electrode PE electrically connected to the drain electrode of the thin film transistor Tr, a common electrode CE facing the pixel electrode PE, and a liquid crystal layer interposed between the pixel electrode PE and the common electrode CE. The liquid crystal capacitor Clc is charged with a charged voltage corresponding to a voltage difference between a data voltage applied to the pixel electrode PE and a first or second common voltage Vcom1 or Vcom2 applied to the common electrode CE. According to exemplary embodiments, the first and second common voltages Vcom1 and Vcom2 are different from each other.

In an exemplary embodiment, the pixels PX may be arranged on the display panel 100 in a configuration to be driven using a Z-inversion driving method, as described in detail with reference to FIG. 2.

The printed circuit board 200 includes a timing controller 210 and a common voltage generator 220. The timing controller 210 receives image signals RGB and control signals CS from an external device. The timing controller 210 converts the data format of the image signals RGB to a data format appropriate for an interface between the data driver 400 and the timing controller 210 to generate image signals R'G'B' having the converted data format. The image signals R'G'B' are applied to the data driver 400.

The timing controller 210 generates a gate control signal G-CS, a data control signal D-CS, and a common voltage control signal V-CS in response to the control signals CS. The timing controller 210 applies the gate control signal G-CS to the gate driver 300, applies the data control signal D-CS to the data driver 400, and applies the common voltage control signal V-CS to the common voltage generator 220.

The common voltage generator 220 receives the common voltage control signal V-CS from the timing controller 210. The common voltage generator 220 generates the first and second common voltages Vcom1 and Vcom2 in response to the common voltage control signal V-CS and applies the first and second common voltages Vcom1 and Vcom2 to the display panel 100. It is to be understood that the number of common voltages is not limited to two.

According to an exemplary embodiment, the common voltage generator 220 applies the first common voltage Vcom1 to first and third common voltage lines VL1 and VL3 of the display panel 100 through the data driver 400. In addition, the common voltage generator 220 applies the second common voltage Vcom2 to second and fourth common voltage lines VL2 and VL4 of the display panel 100 through the data driver 400.

The gate driver 300 sequentially outputs gate signals in response to the gate control signal G-CS provided from the timing controller 210. The gate driver 300 applies the gate signals to the pixels PX disposed on the display panel 100 through the gate lines GL1 to GLn. The pixels PX are sequentially scanned by the gate signals in the unit of a row.

The data driver 400 converts the image signals R'G'B' to data voltages in response to the data control signal D-CS provided from the timing controller 210. The data driver 400 applies the data voltages to the pixels PX disposed on the display panel 100. The data voltages include, for example, first and second data voltages. The pixels PX receive the data voltages in response to the gate signals and display gray-scales corresponding to the data voltages, thereby displaying desired images through the pixels PX.

In an exemplary embodiment, the pixels PX connected to odd-numbered gate lines GL1, GL3, . . . , GLn−1 from among the plurality of gate lines GL1 to GLn receive corresponding data voltages through first to m-th data lines from among the plurality of data lines DL1 to DLm+1. The pixels PX connected to even-numbered gate lines GL2, GL4, . . . , GLn from among the plurality of gate lines GL1 to GLn receive corresponding data voltages through second to (m+1)-th data lines from among the plurality of data lines DL1 to DLm+1. The polarity of each of the data voltages applied to odd-numbered and even-numbered data lines from among the plurality of data lines DL1 to DLm+1 is inverted in every frame unit.

Figure 2:
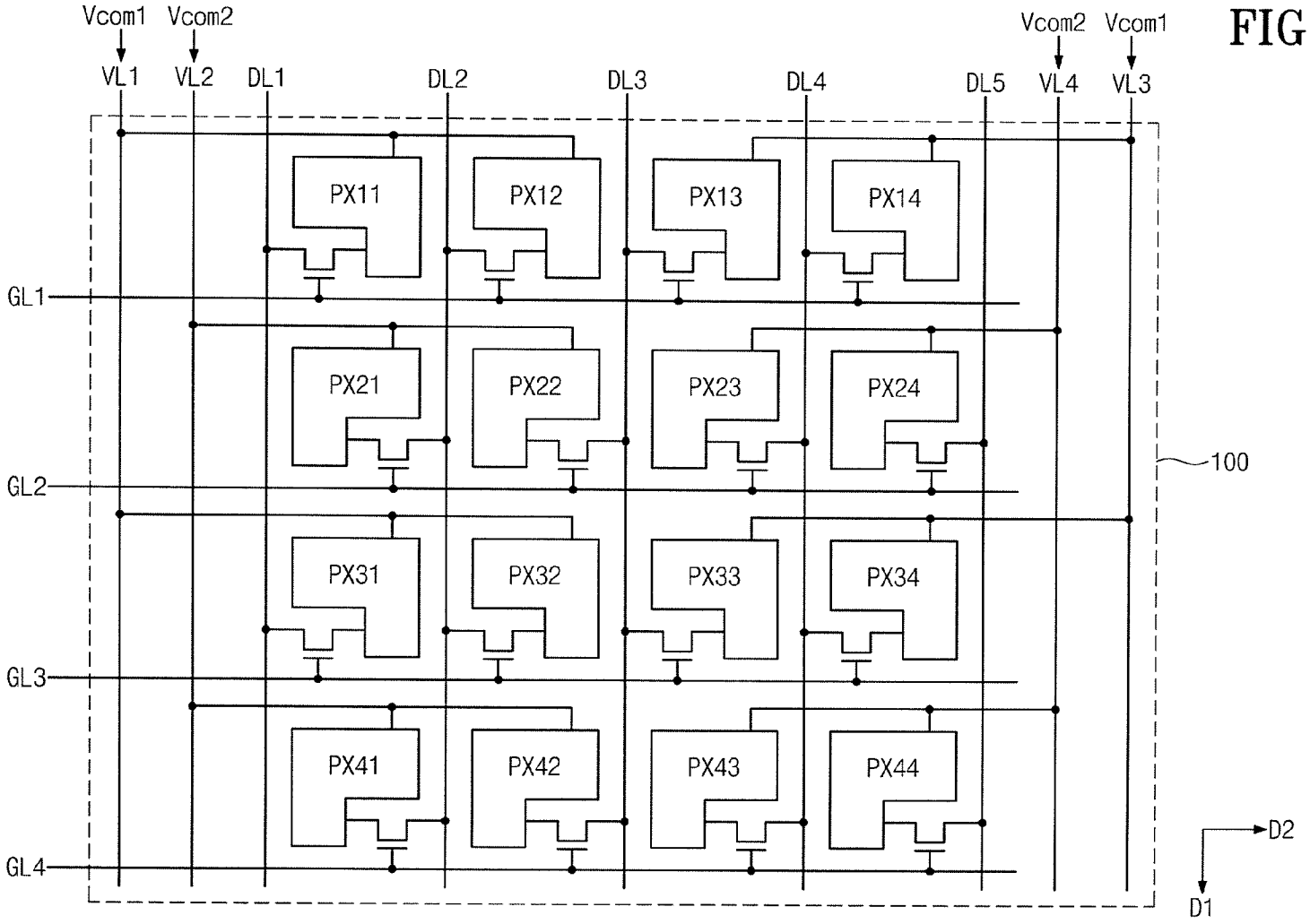
FIG. 2 is a circuit diagram showing an arrangement of the pixels and common voltage lines disposed on the display panel shown in FIG. 1 according to an exemplary embodiment of the present disclosure.

FIG. 2 is a circuit diagram showing an arrangement of the pixels and common voltage lines of the display panel shown in FIG. 1 according to an exemplary embodiment of the present disclosure.

For convenience of explanation, FIG. 2 shows the pixels PX arranged in four rows by four columns. However, it is to be understood that the display panel 100 is not limited to four rows and four columns and to the number of pixels shown in FIG. 2. According to an exemplary embodiment, the display panel 100 may be driven in a Z-inversion driving method.

Referring to FIG. 2, the pixels PX11 to PX44 are connected to the gate lines GL1 to GL4 in the unit of a row. That is, the pixels PX11 to PX44 are connected to the gate lines GL1 to GL4 sequentially arranged in the first direction D1.

The pixels PX11 to PX14 and PX31 to PX34, which are arranged in odd-numbered rows, are connected to the data lines DL1 to DL4 disposed at a first side (e.g., a left side) of the respective pixels, and the pixels PX21 to PX24 and PX41 to PX44, which are arranged in even-numbered rows, are connected to the data lines DL2 to DL5 disposed at a second side (e.g., a right side) of the respective pixels. In an exemplary embodiment, the first and second sides oppose each other.

The pixels PX11 to PX44 are alternately connected to the data lines DL1 to DL4 adjacent to the first side (e.g., the left side) thereof and the data lines DL2 to DL5 adjacent to the second side (e.g., the right side) thereof in the unit of a row.

Hereinafter, the odd-numbered gate lines may also be referred to as first gate lines and the pixels PX11 to PX14 and PX31 to PX34 arranged in the odd-numbered rows may also be referred to as first pixels. The even-numbered gate lines may also be referred to as second gate lines and the pixels PX21 to PX24 and PX41 to PX44 arranged in the even-numbered rows may also be referred to as second pixels.

The first pixels connected to the first gate lines are connected to the first and third common voltage lines VL1 and VL3. For example, the first pixels, which are disposed at a left side of a center portion of the display panel 100 along a direction opposite to the second direction D2, are connected to the first common voltage line VL1. The first pixels, which are disposed at a right side of the center portion of the display panel 100 along the second direction D2, are connected to the third common voltage line VL3. According to an exemplary embodiment, the center portion of the display panel 100 may correspond to a middle data line of the plurality of data lines (e.g., DL3 from among data lines DL1 to DL5 in FIG. 2), or an area near the middle data line of the plurality of data lines.

The second pixels connected to the second gate lines are connected to the second and fourth common voltage lines VL2 and VL4. For example, the second pixels, which are disposed at the left side of the center portion of the display panel 100 along the direction opposite to the second direction D2, are connected to the second common voltage line VL2. The second pixels, which are disposed at the right side of the center portion of the display panel 100 along the second direction D2, are connected to the fourth common voltage line VL4. The second pixels are applied with the second common voltage Vcom2 through the second and fourth common voltage lines VL2 and VL4.

The data voltages based on a column inversion driving method are applied to the data lines DL1 to DL5 in each frame. That is, positive and negative data voltages are alternately applied to the data lines DL1 to DL5 in each frame. For example, when the positive data voltages are applied to the odd-numbered data lines in one frame, the negative data voltages are applied to the even-numbered data lines in the one frame.

The polarity of the data voltages applied to the data lines DL1 to DL5 is inverted every frame. That is, when the positive data voltages are applied to the odd-numbered data lines in a previous frame and the negative data voltages are applied to the even-numbered data lines in the previous frame, the negative data voltages are applied to the odd-numbered data lines in a present frame and the positive data voltages are applied to the even numbered data lines in the present frame. The pixels PX11 to PX44 receive the data voltages through the corresponding data lines in response to the gate signals sequentially provided through the corresponding gate lines in the unit of a row.

Figures 4, 5:
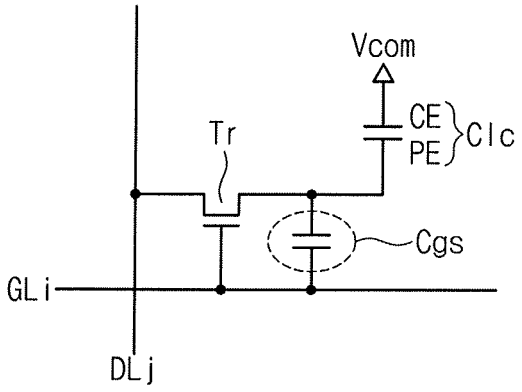
FIG. 4 is a table showing polarities of the pixels shown in FIG. 2 in a second frame according to an exemplary embodiment of the present disclosure.
FIG. 5 is a circuit diagram showing a parasitic capacitor formed between a gate electrode and a source electrode in a display device.

FIG. 3 is a table showing polarities of the pixels shown in FIG. 2 in a first frame. FIG. 4 is a table showing polarities of the pixels shown in FIG. 2 in a second frame.

Referring to FIGS. 2 and 3, the pixels PX11 to PX44 may receive the data voltages during the first frame 1-Frame on the basis of the column inversion driving method. The positive (+) data voltage is applied to the first data line DL1, and thus the first and third pixels PX11 and PX31 connected to the first data line DL1 receive the positive (+) data voltage. The negative (−) data voltage is applied to the second data line DL2, and thus the second and fourth pixels PX21 and PX41 and the second and fourth pixels PX12 and PX32, which are connected to the second data line DL2, receive the negative (−) data voltage. That is, the polarity of the data voltages applied to the odd-numbered data lines is opposite to the polarity of the data voltages applied to the even-numbered data lines.

The positive (+) data voltage is applied to the third data line DL3. Accordingly, the second and fourth pixels PX22 and PX42 and the first and third pixels PX13 and PX33, which are connected to the third data line DL3, receive the positive (+) data voltage. The negative (−) data voltage is applied to the fourth data line DL4, and thus the second and fourth pixels PX23 and PX43 and the first and third pixels PX14 and PX34, which are connected to the fourth data line DL4, receive the negative (−) data voltage.

Referring to FIGS. 2 and 4, during the second frame 2-Frame, the pixels PX11 to PX44 may receive the data voltages having the polarities opposite to those of the data voltages in the first frame 1-Frame on the basis of the column inversion driving method. That is, the first data line DL1 receives the negative (−) data voltage, the second data line DL2 receives the positive (+) data voltage, the third data line DL3 receives the negative (−) data voltage, and the fourth data line DL4 receives the positive (+) data voltage. As a result, the pixels PX11 to PX44 in the first frame 1-Frame have polarities opposite to those of the pixels PX11 to PX44 in the second frame 2-Frame.

Pixels in a display device (e.g., pixels PX11 to PX44) may be driven in a dot inversion driving method during each frame. According to the Z-inversion driving method, the data voltages are applied to the data lines in the same way as that of the column inversion driving method, but the pixels (e.g., PX11 to PX44) may be driven in the same way as the dot inversion driving method. Thus, the power consumption of a display device driven using the Z-inversion driving method may be reduced (e.g., by about 30%) compared to that of a display device driven using the dot inversion driving method.

FIG. 5 is a circuit diagram showing a parasitic capacitor formed between a gate electrode and a source electrode in a display device.

The thin film transistor Tr applies the data voltage provided through the data line DLj to the pixel electrode PE in response to the gate signal provided through the gate line GLi. However, the voltage level of the pixel electrode PE may be slightly reduced due to a kickback voltage during the first and second frames when compared to the voltage level of the positive (+) and negative (−) data voltages. Here, the term kickback voltage refers to a parasitic capacitance caused by a coupling phenomenon occurring between the gate electrode and the source electrode when the gate signal is transitioned to a turn-off state from a turn-on state, or vice versa. That is, the parasitic capacitor Cgs may be formed between the gate electrode and the source electrode of the thin film transistor Tr.

However, as shown in FIG. 2, when the pixels PX are arranged on the display panel 100 in a configuration to be driven using the Z-inversion driving method, the kickback voltage generated between the pixels PX connected to the odd-numbered gate lines may be different from the kickback voltage generated between the pixels PX connected to the even-numbered gate lines. That is, when the constant common voltage is applied to the pixels connected to the odd-numbered and even-numbered gate lines, the voltage level of the positive (+) data voltage may be different from the voltage level of the negative (−) data voltage. The absolute value of the positive (+) data voltage may be about equal to the absolute value of the negative (−) data voltage.

As a result, a voltage effective value of the liquid crystal capacitor Clc corresponding to the pixels connected to the first gate lines may become different from a voltage effective value of the liquid crystal capacitor Clc corresponding to the pixels connected to the second gate lines. The difference of the voltage effective value between the liquid crystal capacitors may cause, for example, a difference in hue and contrast, and thus, abnormal hue and contrast areas may appear on the display panel. Here, the first and second gate lines may be the odd-numbered and even-numbered gate lines described with reference to FIG. 2.

According to exemplary embodiments of the present disclosure, the common voltage generator 220 generates the first and second common voltages Vcom1 and Vcom2 responsive to the common voltage control signal V-CS in consideration of the kickback voltage between the pixels connected to the first and second gate lines.

Figure 6:
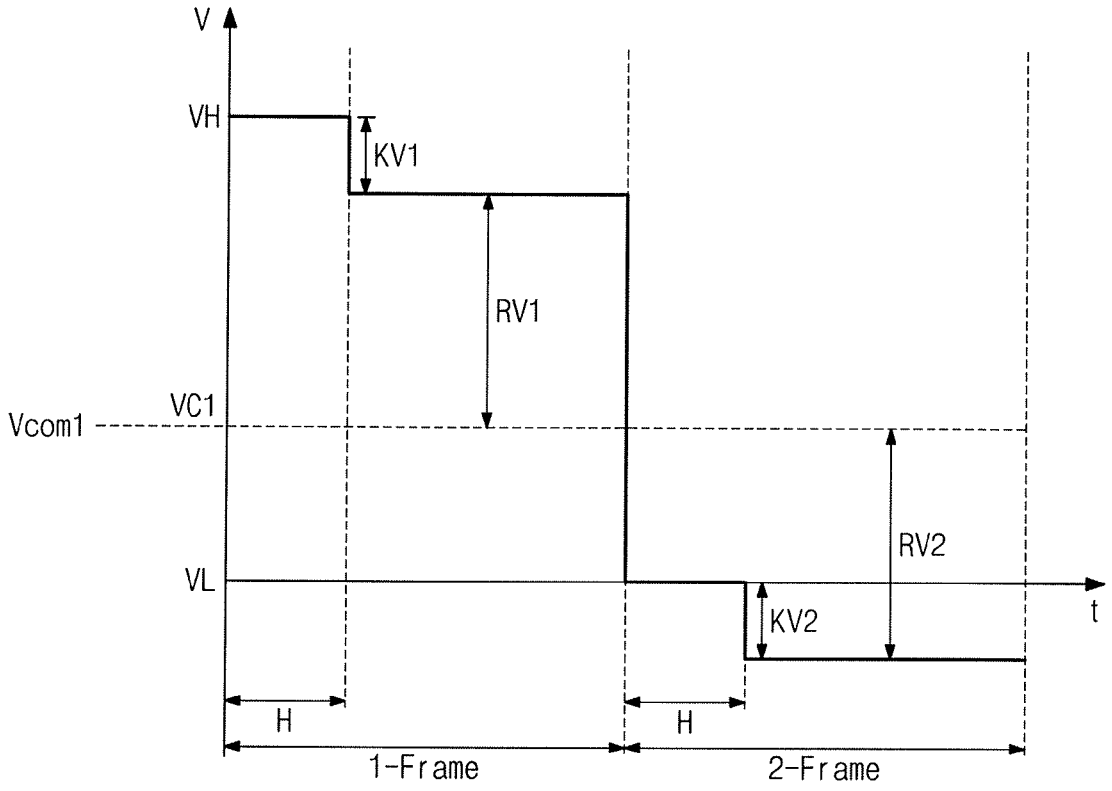
FIGS. 6 and 7 are graphs showing voltage levels of a pixel electrode and a common electrode according to an exemplary embodiment of the present disclosure.
Figure 7:
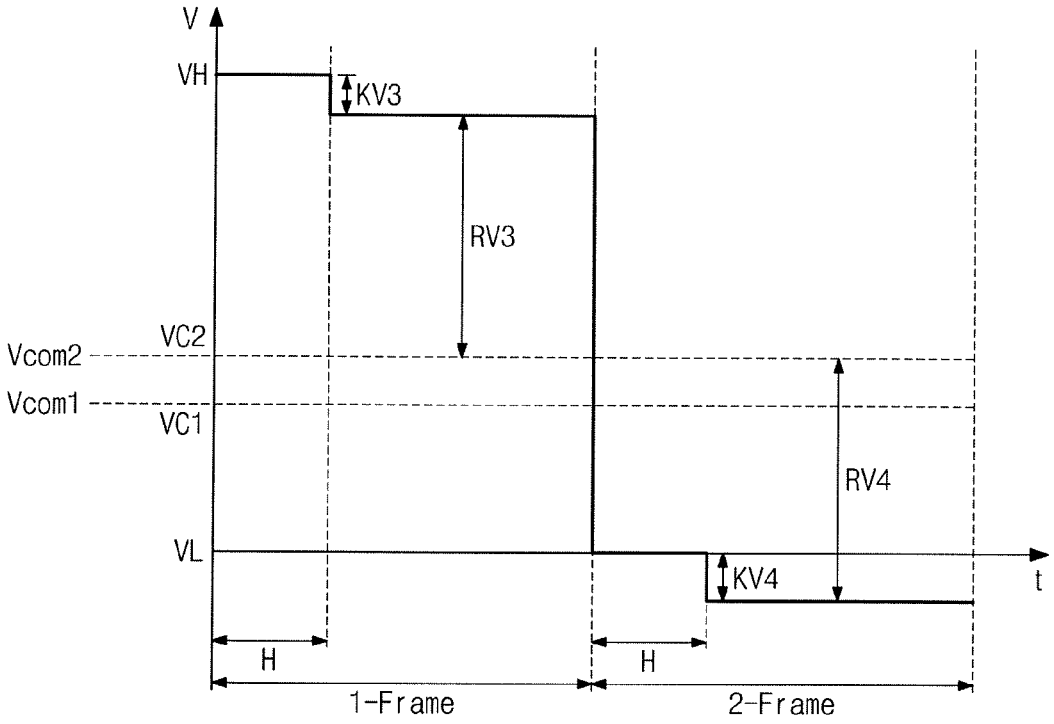

FIGS. 6 and 7 are graphs showing voltage levels of a pixel electrode and a common electrode according to an exemplary embodiment of the present disclosure.

In FIG. 6, the x-axis indicates time (t) and the y-axis indicates a voltage level (V) of the pixel electrode.

The common voltage generator 220 generates the first common voltage Vcom1 applied to the pixels connected to the odd-numbered gate lines. The voltage level of the first common voltage Vcom1 may be a first voltage level VC1. FIG. 6 shows a voltage level of a first pixel electrode corresponding to any one pixel from among the pixels connected to the odd-numbered gate lines.

The first pixel electrode receives the corresponding data voltage during an activation time period H in which the gate signal is transitioned to the high level during the first frame 1-Frame. Here, the first pixel electrode is applied with the positive (+) data voltage corresponding to the high level VH during the first frame 1-Frame. Then, the first pixel electrode does not receive the data voltage after the activation time period H is finished, since the gate signal is transitioned to the low level. In this case, the voltage level of the first pixel electrode is reduced from the high level VH by a first kickback voltage KV1.

During the second frame 2-Frame, the first pixel electrode receives the corresponding data voltage during the activation time period H in which the gate signal is transitioned to the high level. Here, the first pixel electrode is applied with the negative (−) data voltage corresponding to the low level VL during the second frame 2-Frame. Then, the first pixel electrode does not receive the data voltage after the activation time period H is finished, since the gate signal is transitioned to the low level. In this case, the voltage level of the first pixel electrode is reduced from the low level VL by a second kickback voltage KV2.

According to an exemplary embodiment, the common voltage generator 220 generates the first common voltage Vcom1 on the basis of the first and second kickback voltages KV1 and KV2.

The liquid crystal capacitor Clc of the pixel maintains a first effective voltage RV1 during the first frame 1-Frame. The first effective voltage RV1 corresponds to a voltage difference between the first common voltage Vcom1 and a voltage obtained by subtracting the first kickback voltage KV1 from the positive (+) data voltage corresponding to the high level VH. In addition, the liquid crystal capacitor Clc of the pixel maintains a second effective voltage RV2 during the second frame 2-Frame. The second effective voltage RV2 corresponds to a voltage difference between the first common voltage Vcom1 and a voltage obtained by subtracting the second kickback voltage KV2 from the negative (−) data voltage corresponding to the low level VL. That is, the common voltage generator 220 generates the first common voltage Vcom1 such that the absolute value of the first effective voltage RV1 is about equal to the absolute value of the second effective voltage RV2.

In FIG. 7, the x-axis indicates time (t) and the y-axis indicates a voltage level (V) of the pixel electrode.

The common voltage generator 220 generates the second common voltage Vcom2 applied to the pixels connected to the even-numbered gate lines. The voltage level of the second common voltage Vcom2 may be a second voltage level VC2. FIG. 7 shows a voltage level of a second pixel corresponding to any one pixel from among the pixels connected to the even-numbered gate lines.

Since the pixels PX are arranged on the display panel 100 in consideration of the Z-inversion driving method, the kickback voltages of the pixels connected to the odd-numbered and even-numbered gate lines may be different from each other. For example, the voltage level of the first kickback voltage KV1 generated in the pixels connected to the odd-numbered gate lines during the first frame 1-Frame may be different from the voltage level of the third kickback voltage KV3 generated in the pixels connected to the even-numbered gate lines.

The second pixel electrode receives the corresponding data voltage during the activation time period H in which the gate signal is transitioned to the high level during the first frame 1-Frame. Here, the second pixel electrode is applied with the positive (+) data voltage corresponding to the high level VH during the first frame 1-Frame. Then, the second pixel electrode does not receive the data voltage after the activation time period H is finished, since the gate signal is transitioned to the low level. In this case, the voltage level of the second pixel electrode is reduced from the high level VH by the third kickback voltage KV3.

During the second frame 2-Frame, the second pixel electrode receives the corresponding data voltage during the activation time period H in which the gate signal is transitioned to the high level. Here, the second pixel electrode is applied with the negative (−) data voltage corresponding to the low level VL during the second frame 2-Frame. Then, the second pixel electrode does not receive the data voltage after the activation time period H is finished, since the gate signal is transitioned to the low level. In this case, the voltage level of the second pixel electrode is reduced from the low level VL by a fourth kickback voltage KV4.

According to an exemplary embodiment, the common voltage generator 220 generates the second common voltage Vcom2 on the basis of the third and fourth kickback voltages KV3 and KV4.

The liquid crystal capacitor Clc of the pixel maintains a third effective voltage RV3 during the first frame 1-Frame. The third effective voltage RV3 corresponds to a voltage difference between the second common voltage Vcom2 and a voltage obtained by subtracting the third kickback voltage KV3 from the positive (+) data voltage corresponding to the high level VH. In addition, the liquid crystal capacitor Clc of the pixel maintains a fourth effective voltage RV4 during the second frame 2-Frame. The fourth effective voltage RV4 corresponds to a voltage difference between the second common voltage Vcom2 and a voltage obtained by subtracting the fourth kickback voltage KV4 from the negative (−) data voltage corresponding to the low level VL. That is, the common voltage generator 220 generates the second common voltage Vcom2 such that the absolute value of the third effective voltage RV3 is about equal to the absolute value of the fourth effective voltage RV4.

As described above, the common voltage generator 220 generates the first and second common voltages Vcom1 and Vcom2 on the basis of the kickback voltages of the pixels connected to the first and second gate lines. As a result, the effective voltages of the pixels connected to the first and second gate lines may be constantly maintained. Accordingly, a crosstalk phenomenon, which may be caused when the effective voltages between the pixels connected to the first and second gate lines are different from each other, may be reduced or prevented from occurring. Therefore, the visibility of the display panel may be improved.

Figure 8:
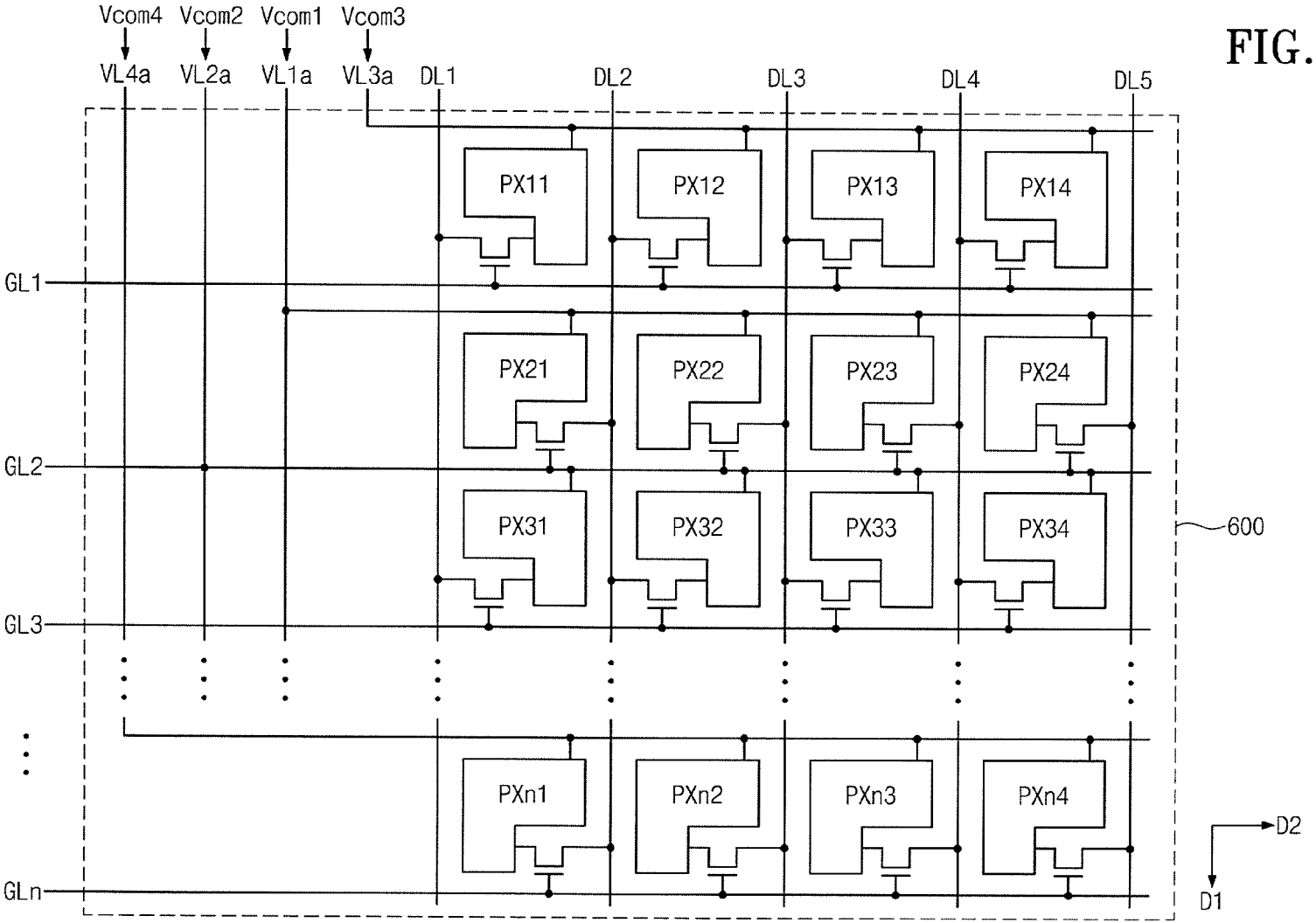
FIG. 8 is a circuit diagram showing an arrangement of pixels and common voltage lines disposed on a display device according to an exemplary embodiment of the present disclosure.

FIG. 8 is a circuit diagram showing an arrangement of pixels and common voltage lines disposed on a display device according to an exemplary embodiment of the present disclosure.

Referring to FIG. 8, first, second, third, and fourth common voltage lines VL1*a*, VL2*a*, VL3*a*, and VL4*a* are disposed at a left side of a display panel 600. That is, compared to the display panel 100 shown in FIG. 2, two additional common voltage lines are further disposed at the left side of the pixels PX11 to PX44/PXn4. In the exemplary embodiment shown in FIG. 8, the four common voltage lines VL1*a* to VL4*a* are disposed at the left side of the pixels PX11 to PX44/PXn4, however, exemplary embodiments are not limited thereto. For example, in exemplary embodiments, the four common voltage lines VL1*a* to VL4*a* may be further disposed at the right side of the pixels PX11 to PX44/PXn4. Further, it is to be understood that the number of the common voltage lines shown in FIGS. 2 and 8 is not limited thereto.

The common voltage generator 220 generates first, second, third, and fourth common voltages Vcom1, Vcom2, Vcom3, and Vcom4. The common voltage generator 220 applies the first to fourth common voltages Vcom1 to Vcom4 to the first to fourth common voltage lines VL1*a* to VL4*a*, respectively. It is to be understood that the number of the common voltages is not limited thereto, and that the number of the pixels arranged on the display panel 600 is not be limited to the pixels PX11 to PXn4. According to exemplary embodiments, the first, second, third, and fourth common voltages Vcom1, Vcom2, Vcom3, and Vcom4 are different from each other.

In a typical display device, the common voltage is applied to the common electrode in each pixel. However, a loss in common voltage may be generated while the common voltage is applied to each pixel through the common voltage line, and the loss of the common voltage may be increased proportional to a length of the common voltage line.

In the display panel 600 according to an exemplary embodiment of the present disclosure, the third and fourth common voltages Vcom3 and Vcom4 are applied to the pixels connected to the first and n-th gate lines GL1 and GLn. Except for the third and fourth common voltages Vcom3 and Vcom4, the operation of the display panel 600 shown in FIG. 8 may be substantially the same as the operation of the display panel 100 shown in FIG. 2.

The pixels PX11 to PX14 connected to the first gate line GL1 are applied with the third common voltage Vcom3 through the third common voltage line VL3*a*. In addition, the pixels PXn1 to PXn4 connected to the n-th gate line GLn are applied with the fourth common voltage Vcom4 through the fourth common voltage line VL4*a*. In this case, the pixels PXn1 to PXn4 connected to the n-th gate line GLn are disposed further away from the common voltage generator 220 than the pixels PX11 to PX14 connected to the first gate line GL1. As a result, the common voltage generator 220 generates the third and fourth common voltages Vcom3 and Vcom4 such that the voltage level of the fourth common voltage Vcom4 is higher than the voltage level of the third common voltage Vcom3 by a predetermined voltage level.

As described above, according to exemplary embodiments of the present disclosure, the common voltage generator 220 generates the common voltages in consideration of the arrangement of the pixels.

While the present disclosure has been particularly shown and described with reference to the exemplary embodiments thereof, it will be understood by those of ordinary skill in the art that various changes in form and detail may be made therein without departing from the spirit and scope of the present disclosure as defined by the following claims.

What is claimed is:

1. A display device, comprising:

a display panel comprising a plurality of gate lines, a plurality of data lines, and a plurality of pixels connected to the plurality of gate lines and the plurality of data lines;

a data driver configured to apply a plurality of data voltages to the plurality of pixels through the plurality of data lines; and a common voltage generator configured to apply a first common voltage and a second common voltage to the plurality of pixels, wherein pixels of the plurality of pixels connected to odd-numbered gate lines of the plurality of gate lines are connected to data lines of the plurality of data lines disposed at a first side thereof, pixels of the plurality of pixels connected to even-numbered gate lines of the plurality of gate lines are connected to data lines of the plurality of data lines disposed at a second side thereof, and the common voltage generator is configured to apply the first common voltage to the pixels of the plurality of pixels connected to the odd-numbered gate lines and apply the second common voltage to the pixels of the plurality of pixels connected to the even-numbered gate lines.

2. The display device of claim 1, further comprising:

a timing controller configured to generate a common voltage control signal in response to an external control signal, wherein the common voltage generator is configured to generate the first and second common voltages in response to the common voltage control signal.

3. The display device of claim 2, wherein the timing controller is configured to generate a data control signal, the data driver is configured to generate the plurality of data voltages in response to the data control signal, and the plurality of pixels receive the plurality of data voltages through the plurality of data lines.

4. The display device of claim 1, wherein the data driver is configured to apply positive data voltages to odd-numbered data lines of the plurality of data lines during a first frame.

5. The display device of claim 4, wherein the data driver is configured to apply negative data voltages to the odd-numbered data lines of the plurality of data lines during a second frame following the first frame.

6. The display device of claim 1, wherein the data driver is configured to apply negative data voltages to even-numbered data lines of the plurality of data lines during a first frame.

7. The display device of claim 6, wherein the data driver is configured to apply positive data voltages to the even-numbered data lines of the plurality of data lines during a second frame following the first frame.

8. The display device of claim 1, wherein a polarity of data voltages of the plurality of data voltages applied to odd-numbered data lines of the plurality of data lines and a polarity of data voltages of the plurality of data voltages applied to even-numbered data lines of the plurality of data lines are opposite to each other in each frame and inverted in each frame.

9. The display device of claim 1, wherein the display panel comprises first and second common voltage lines disposed thereon, the pixels of the plurality of pixels connected to the odd-numbered gate lines of the plurality of gate lines receive the first common voltage through the first common voltage line, and the pixels of the plurality of pixels connected to the even-numbered gate lines of the plurality of gate lines receive the second common voltage through the second common voltage line.

10. The display device of claim 1, wherein each of the plurality of pixels comprises:

a pixel electrode that receives a corresponding data voltage from among the plurality of data voltages;

a common electrode that receives the first common voltage or the second common voltage; and a liquid crystal capacitor charged with a charged voltage corresponding to a voltage difference between the corresponding data voltage and the first or second common voltage.

11. The display device of claim 10, wherein the first common voltage is generated based on the charged voltage charged in the liquid crystal capacitor of the pixels of the plurality of pixels connected to the odd-numbered gate lines of the plurality of gate lines during a first frame and the charged voltage charged in the liquid crystal capacitor of the pixels of the plurality of pixels connected to the odd-numbered gate lines of the plurality of gate lines during a second frame following the first frame.

12. The display device of claim 10, wherein the second common voltage is generated based on the charged voltage charged in the liquid crystal capacitor of the pixels of the plurality of pixels connected to the even-numbered gate lines of the plurality of gate lines during a first frame and the charged voltage charged in the liquid crystal capacitor of the pixels of the plurality of pixels connected to the even-numbered gate lines of the plurality of gate lines during a second frame following the first frame.

13. The display device of claim 1, wherein the display panel comprises a plurality of common voltage lines disposed thereon and the common voltage generator is configured to apply the first and second common voltages to the plurality of common voltage lines.

14. The display device of claim 1, wherein the common voltage generator is configured to output at least one additional common voltage in addition to the first and second common voltages, the display panel comprises a plurality of common voltage lines disposed thereon, and the common voltage generator is configured to output the first common voltage, the second common voltage, and the at least one additional common voltage to the plurality of common voltage lines.

15. The display device of claim 1, wherein the plurality of pixels are driven using a Z-inversion driving method.

16. A method of driving a display device, comprising:

applying a plurality of data voltages to a plurality of pixels of the display device through a plurality of data lines;

applying a first common voltage to pixels of the plurality of pixels connected to odd-numbered gate lines of a plurality of gate lines; and applying a second common voltage to pixels of the plurality of pixels connected to even-numbered gate lines of the plurality of gate lines, wherein the pixels of the plurality of pixels connected to the odd-numbered gate lines of the plurality of gate lines are connected to data lines of the plurality of data lines disposed at a first side thereof, and the pixels of the plurality of pixels connected to the even-numbered gate lines of the plurality of gate lines are connected to data lines of the plurality of data lines disposed at a second side thereof.

17. The method of claim 16, further comprising applying positive data voltages to odd-numbered data lines of the plurality of data lines during a first frame.

18. The method of claim 17, further comprising applying negative data voltages to the odd-numbered data lines of the plurality of data lines during a second frame following the first frame.

19. The method of claim 16, further comprising applying negative data voltages to even-numbered data lines of the plurality of data lines during a first frame.

20. The method of claim 19, further comprising applying positive data voltages to the even-numbered data lines of the plurality of data lines during a second frame following the first frame.

* * * * *